US005118056A

United States Patent [19]

Jeanise

[11] Patent Number: 5,118,056

[45] Date of Patent: Jun. 2, 1992

[54] BARRICADE APPARATUS

[76] Inventor: Dorothy J. Jeanise, 1020 Irving St., Orange, Tex. 77630

[21] Appl. No.: 673,312

[22] Filed: Mar. 22, 1991

[51] Int. Cl.[5] ..... B61L 23/00

[52] U.S. Cl. ..... 246/127; 49/9; 49/93; 246/111

[58] Field of Search ..... 246/111, 112, 113, 114 R, 246/114, A, 118, 119, 127, 261, 272, 292; 49/9, 58, 93, 124, 263, 33; 238/1

[56] References Cited

U.S. PATENT DOCUMENTS

| | | | |
|---|---|---|---|
| 351,552 | 10/1886 | Wilder | 49/93 |
| 1,213,292 | 1/1917 | Stoll et al. | 49/93 |
| 1,661,050 | 2/1928 | Siano | 246/127 |
| 1,759,742 | 5/1930 | Galizia | 49/93 X |
| 1,773,043 | 8/1930 | King | 49/93 |
| 2,189,974 | 2/1940 | Buford | 49/9 |
| 2,336,483 | 12/1943 | Hoover | 49/9 |
| 2,394,330 | 3/1946 | Sawyer | 49/9 |

*Primary Examiner*—Robert J. Spar
*Assistant Examiner*—James Eller
*Attorney, Agent, or Firm*—Leon Gilden

[57] ABSTRACT

An apparatus wherein a barricade structure is positioned in a first orientation below ground level and raised to a second position in above ground level orientation to provide a barricade relative to various railroad crossings and the like. The apparatus includes spaced parallel posts mounting a plurality of equally spaced bars therebetween, the bars include shock-absorbing plates equally spaced orthogonally relative to the bars and parallel to the posts. An individual or plurality of spools effects raising and lowering of the organization.

6 Claims, 4 Drawing Sheets 10
9
12
16
17
18
19
24
25
29
30
32
33
34
35
39
40
41
42
43

BARRICADE APPARATUS

BACKGROUND OF THE INVENTION

1. Field of the Invention

The field of invention relates to barricade structure, and more particularly pertains to a new and improved barricade apparatus wherein the same is raised to effect blocking of various roadways and the like for use at intersections and crossings subject to hazardous traverse of trains, boats, and the like.

2. Description of the Prior Art

Barricade apparatus of various types have been utilized in the prior art. Specifically, such barricade apparatus is utilized to effect abutment of traffic relative to a crossing. Such crossings are frequently found in railway type environments, but may be utilized to prevent access to various bridges and the like when travel of boats and such are directed therethrough. Such prior art may be exemplified in U.S. Pat. No. 3,643,864 to Ziegler setting forth an organization providing crossing protection to the rail attachment to its road bed and ballast bed.

U.S. Pat. No. 4,666,108 to Fox sets forth an extensible railroad grade crossing arm arranged for pivotment to block access to a through-extending roadway at a railway crossing.

U.S. Pat. No. 4,093,120 to Canfield sets forth a railroad crossing structure utilizing elastomeric pads mounted upon a flexible plate providing cushioning to vehicles traversing the railroad crossing.

U.S. Pat. No. 4,369,943 to Hussein sets forth a model train crossing gate, and U.S. Pat. No. 4,897,960 to Barbinek, et al. are examples of crossing gate structures of a pivoting construction.

As such, it may be appreciated that there continues to be a need for a new and improved barricade apparatus as set forth by the instant invention which provides an effective and rigid protection relative to railroad crossings preventing access of traffic therethrough and in this respect, the present invention substantially fulfills this need.

SUMMARY OF THE INVENTION

In view of the foregoing disadvantages inherent in the known types of railroad crossing apparatus now present in the prior art, the present invention provides a barricade apparatus wherein the same is reciprocatably mounted from a first position underlying a road bed to a second position overlying the road bed to effect barricading of traffic through a railroad crossing. As such, the general purpose of the present invention, which will be described subsequently in greater detail, is to provide a new and improved barricade apparatus which has all the advantages of the prior art railroad crossing apparatus and none of the disadvantages.

To attain this, the present invention provides an apparatus wherein a barricade structure is positioned in a first orientation below ground level and raised to a second position in above ground level orientation to provide a barricade relative to various railroad crossings and the like. The apparatus includes spaced parallel posts mounting a plurality of equally spaced bars therebetween, the bars include shock-absorbing plates equally spaced orthogonally relative to the bars and parallel to the posts. An individual or plurality of spools effects raising and lowering of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved barricade apparatus which has all the advantages of the prior art railroad crossing apparatus and none of the disadvantages.

It is another object of the present invention to provide a new and improved barricade apparatus which may be easily and efficiently manufactured and marketed.

It is a further object of the present invention to provide a new and improved barricade apparatus which is of a durable and reliable construction.

An even further object of the present invention is to provide a new and improved barricade apparatus which is susceptible of a low cost of manufacture with regard to both materials and labor, and which accordingly is then susceptible of low prices of sale to the consuming public, thereby making such barricade apparatus economically available to the buying public.

Still yet another object of the present invention is to provide a new and improved barricade apparatus which provides in the apparatuses and methods of the prior art some of the advantages thereof, while simultaneously overcoming some of the disadvantages normally associated therewith.

Still another object of the present invention is to provide a new and improved barricade apparatus wherein the same is reciprocatably mounted relative to a railroad crossing to effect positioning of a barricade in a raised and lowered position providing an unobtrusive structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2A is a cross sectional view, taken along lines 2A—2A of FIG. 2 in the direction indicated by the arrows.

DESCRIPTION OF THE PREFERRED EMBODIMENT

Figures 1, 2, 3:
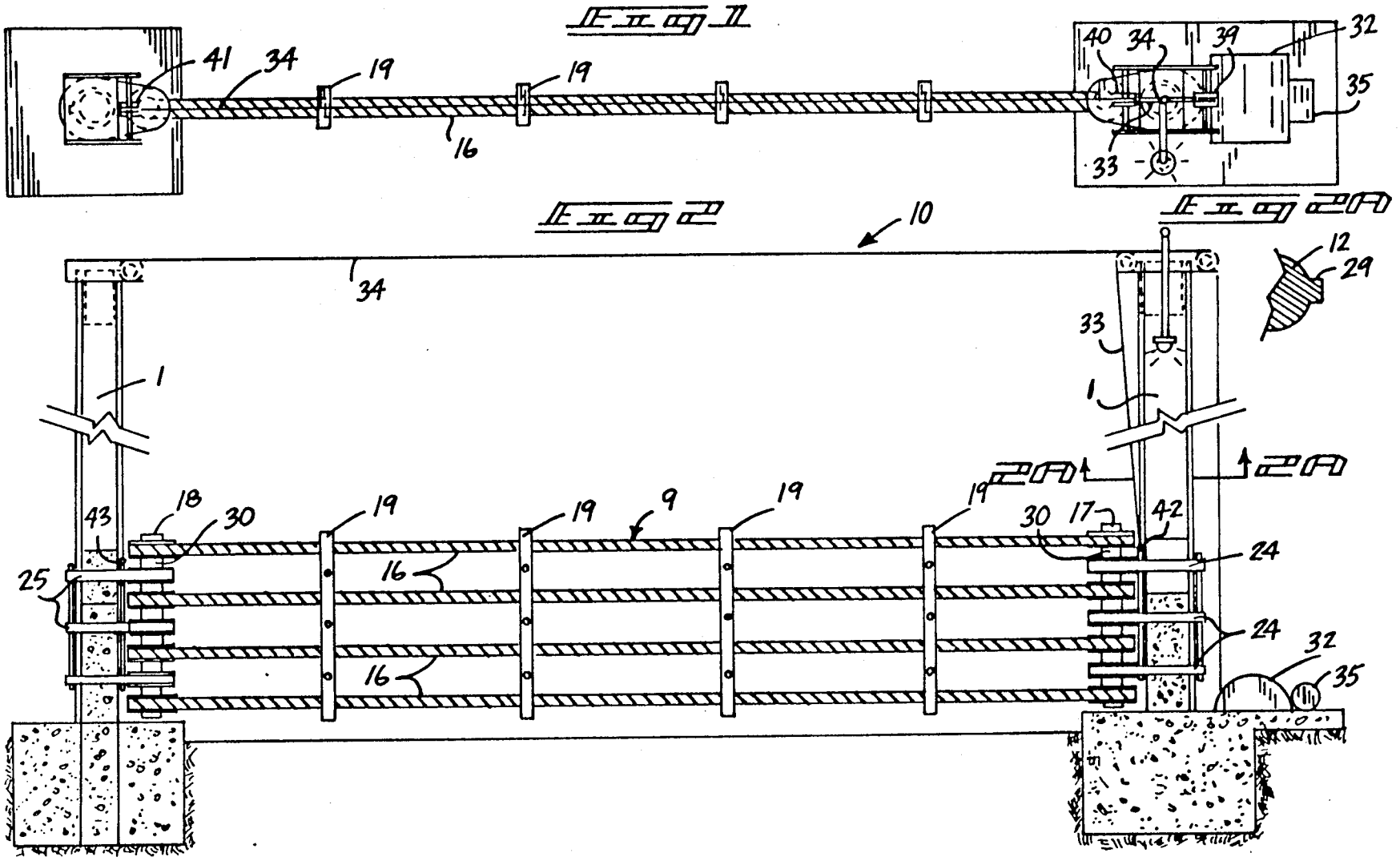
FIG. 1 is an orthographic top view of the instant invention.
FIG. 2 is an orthographic side view of the instant invention.
FIG. 3 is an orthographic side view of the instant invention in a raised orientation relative to a road surface.
Figure 3:
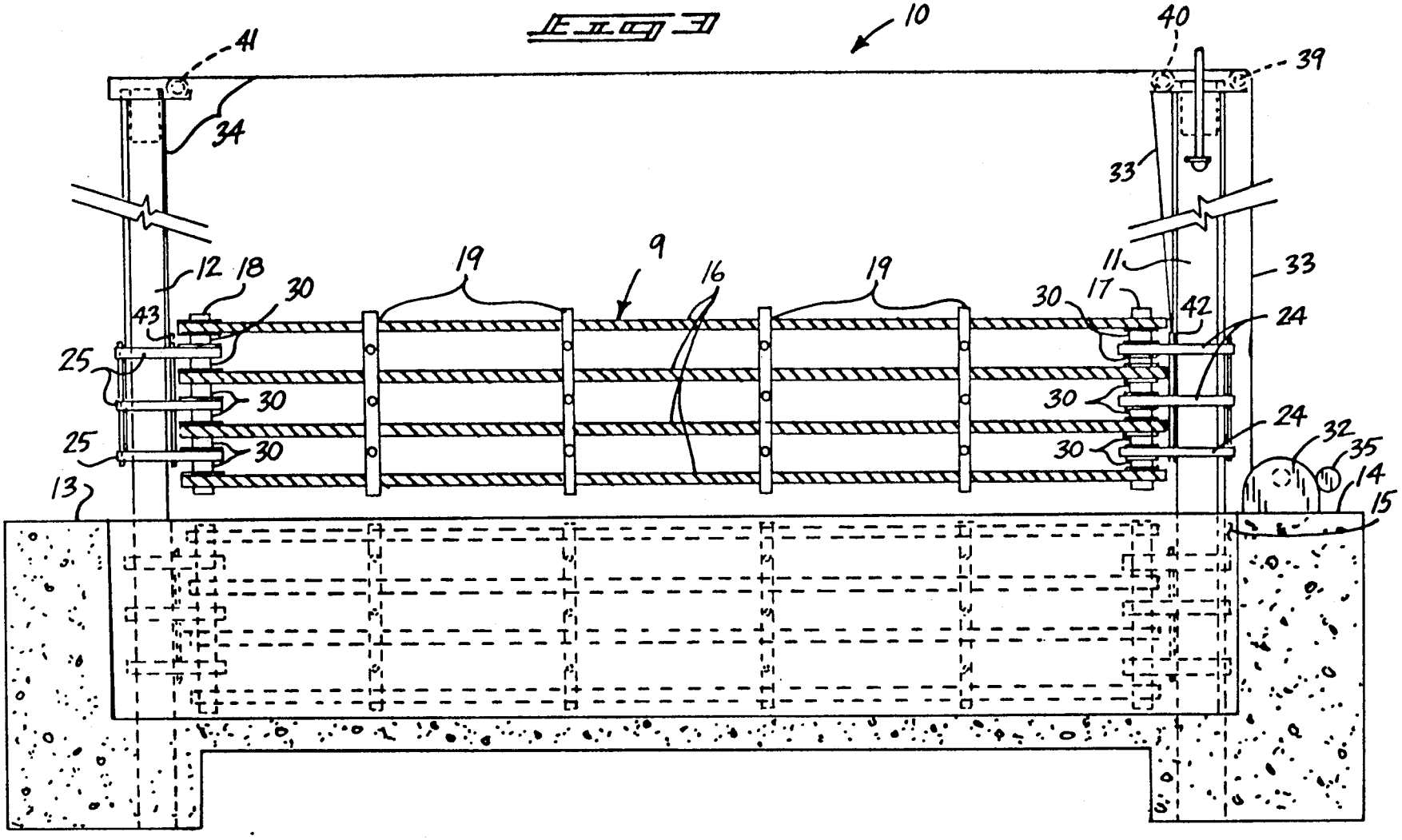
Figure 4:
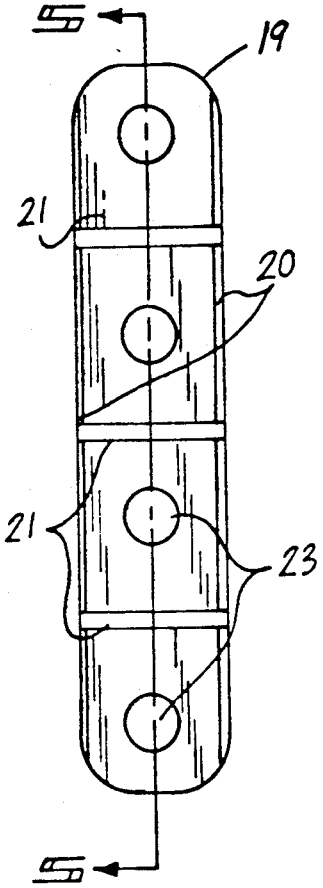
FIG. 4 is an orthographic frontal view of a shock-absorbing spacer plate utilized by the instant invention.
Figure 5:
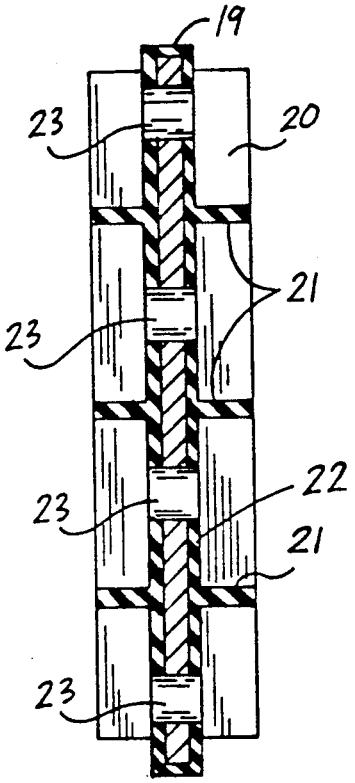
FIG. 5 is an orthographic view, taken along the lines 5—5 of FIG. 4 in the direction indicated by the arrows.
Figure 6:
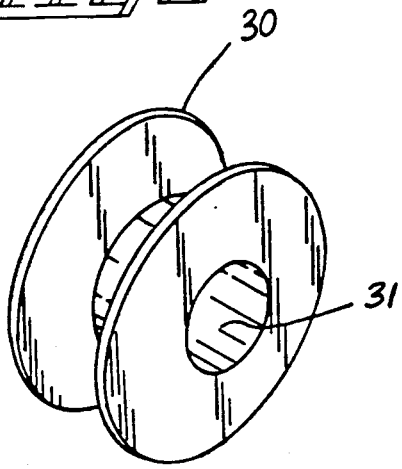
FIG. 6 is an isometric illustration of a spacer member utilized by the instant invention.
Figure 7:
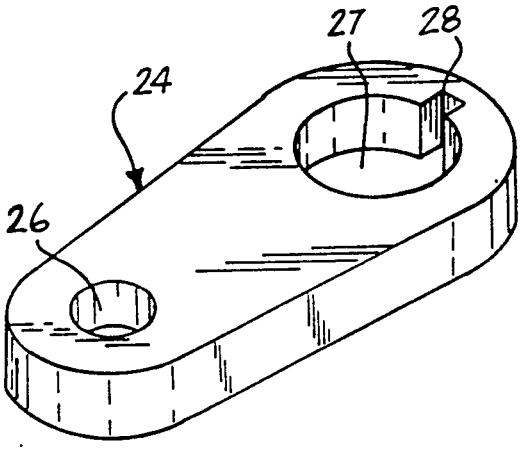
FIG. 7 is an isometric illustration of a guide collar utilized by the instant invention.

With reference now to the drawings, and in particular to FIGS. 1 to 9 thereof, a new and improved barricade apparatus embodying the principles and concepts of the present invention and generally designated by the reference numeral 10 will be described.

More specifically, the barricade apparatus 10 of the instant invention essentially comprises a vertical first support column 11 spaced from and parallel to a second support column 12. The support columns are spaced apart a predetermined spacing to provide traverse of traffic therebetween. A rigid foundation 13 of a unitary construction is provided formed with a top surface 14 coplanar with the road surface, including a cavity slot 15 directed between and including the support columns to receive a barricade 9 therewithin. The barricade includes a plurality of parallel rails 16 that are defined by a predetermined height and predetermined length substantially equal to the predetermined spacing to be received within the cavity slot 15. The parallel rails 16 are of a rigid construction and are orthogonally oriented relative to the first and second support columns 11 and 12 directed therebetween. A rigid right mounting bar 17 and a rigid left mounting bar 18 that are orthogonally oriented relative to the parallel rails 16 and parallel relative to one another and the support columns are positioned adjacent opposed right and left end portions of the parallel rails and directed therethrough. Equally spaced shock absorbing spacer plates 19 receive the parallel rails 16 therethrough and are positioned between the right and left mounting bars 17 and 18. The spacer plates 19 are arranged parallel relative to one another and the respective right and left mounting bars 17 and 18. The spacer plates 19 (see FIG. 4) each include rigid, parallel side plates 20 positioned on opposed sides of the rails 16 and include resilient mounting webs 21 orthogonally oriented between the parallel side plates 20, and include a central web 22 orthogonally directed between the mounting webs 21 and positioned longitudinally of and coextensively directed between the side plates 20. The central web 22 includes a plurality of equally spaced rail openings 23. Each opening 23 receives a respective parallel rail 16 therethrough. The shock absorbing spacer plates 19 provide shock absorbing positioning of the rails 16 to minimize fracture and stressing of the organization in use, as well as accommodating flexure of the organization upon impact of a vehicle With the barricade.

Orthogonally mounted to and positioned between each of the rails 16 is a respective right and left guide collar 24 and 25 orthogonally mounted to a respective right and left mounting bar 17 and 18. The guide collars 24 and 25 are each formed with a first bore coaxially parallel and spaced from a second bore 27. The first bore 26 is of a lesser diameter than the second bore 27, wherein the first bore 26 of each of the respective collars 24 and 25 is mounted about the respective right and left mounting bars 17 and 18, wherein the second bore 27 is slidably mounted in surrounding relationship relative to the respective right and left support column 11 and 12. Further, each support column 11 and 12 includes a column guide rib 29 coextensive with each exterior surface of the column opposed to the barricade 9, wherein each guide rib 29 is received within an associated guide rib 28 in communication with the second bore 27 to maintain alignment of the barricade. Further, a spool shaped spacer member 30 is positioned between each collar and rail to align the rails relative to the barricade, wherein each of the spacer members 30 includes a spacer bore 31 receiving a respective right and left mounting bar therebetween.

Further, a first spool 32 mounting upon the foundation 13 on the top surface 14 thereof includes a first guide cable 33 and a second guide cable 34 wound thereabout, wherein the spool 32 is selectively rotated in a counter-clockwise or clockwise manner by a first drive motor 35. The first guide cable 33 is directed about a first outer pulley 39 and a first inner pulley 40 that are mounted rotatably to an upper end of the first column 11, wherein the first guide cable 33 is thereafter directed downwardly along the first column and mounted to a first mounting hook 42 that is mounted on the barricade apparatus either on a mounting bar 17 or 18 or on an uppermost guide collar 24 or 25. The second guide cable 34 is directed over the first outer pulley 39, the first inner pulley 40, and then is directed to the top of the second support column 12 wound about a second inner pulley 42 and thereafter downwardly to a second mounting hook 43.

Figures 8, 9:
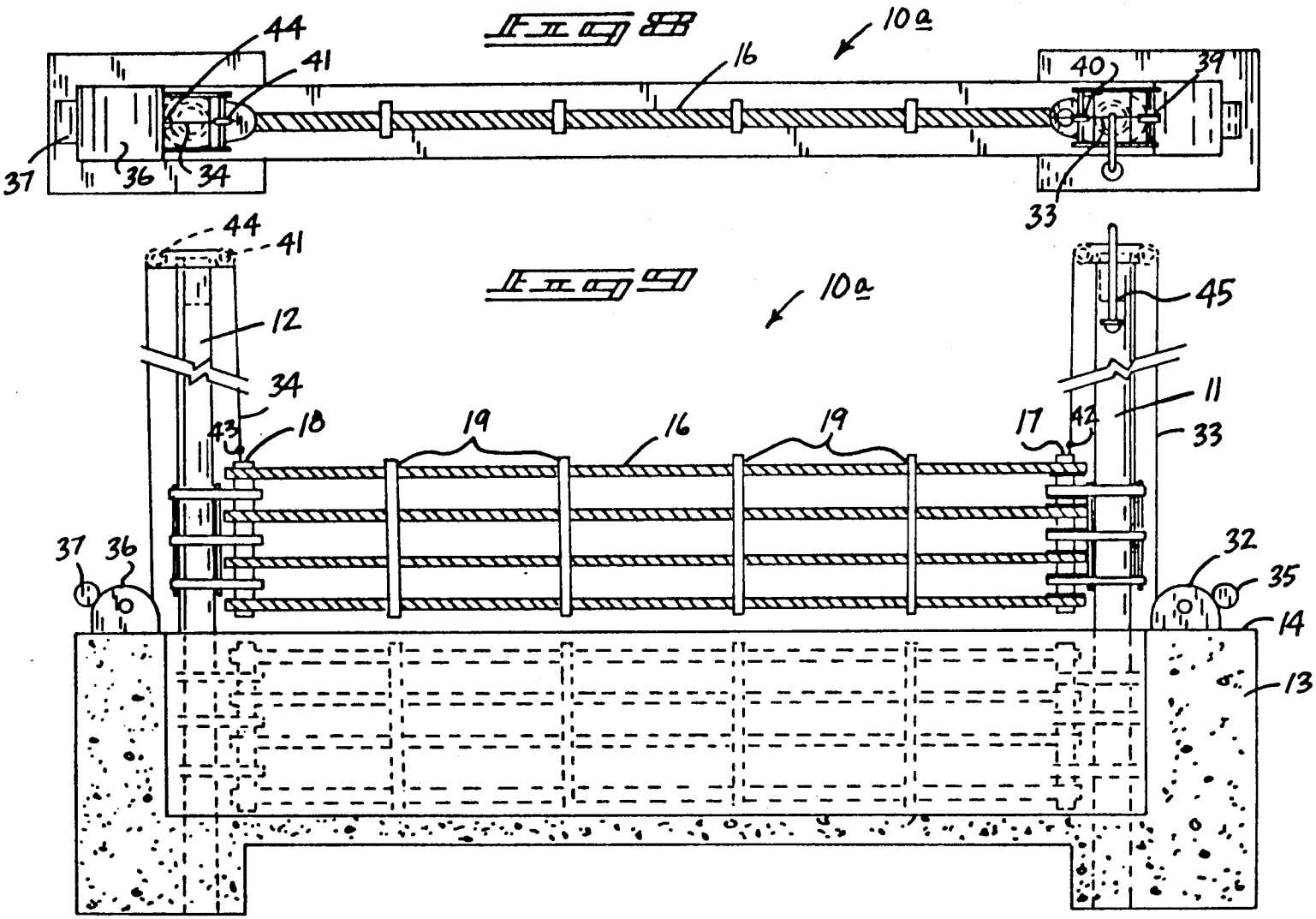
FIG. 8 is an orthographic top view of a modified apparatus utilized by the instant invention.
FIG. 9 is an orthographic side view, taken in elevation, of the modified apparatus in a raised orientation relative to a roadway surface.

In a modified aspect of the invention, as illustrated in FIGS. 8 and 9, a second spool 36 and a second drive motor 37 are mounted adjacent the second column 12, wherein the second guide cable 34 is directed about a second outer pulley 44, then to the second inner pulley 41, and downwardly to the second mounting hook 43 to effect reciprocation of the barricade structure 9 within the cavity slot 15. It should be noted that the cavity slot 15 is defined by a predetermined height substantially equal to the barricade apparatus to completely encompass the barricade apparatus within the cavity slot when in a lowered position, as illustrated in FIGS. 3 and 9 for example.

It should be understood, that a signal light 45 is mounted at least to the first column, as illustrated in FIG. 9 for example, wherein the signal light is arranged to be actuated by switching within an associated railroad track structure (not shown) for actuation of the signal light and effecting reciprocation of the barricade in a conventional manner, such as utilized in the operation of barricade structure in cooperation with railroad track apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A barricade apparatus in cooperation with a railroad crossing defined by a road surface, wherein the apparatus comprises, a rigid foundation, the rigid foundation including a top surface, the top surface aligned with the road surface, and the rigid foundation including an elongate cavity slot defined by a predetermined height and a predetermined length, and a first support column and a second support column mounted within the cavity slot and extending outwardly thereof in an orthogonal relationship relative to the top surface, wherein the first and second support columns are spaced apart a predetermined spacing, and the first and second support columns reciprocatably mounting a barricade therebetween, the barricade defined by a barricade spacing substantially equal to the predetermined spacing and defined by a barricade height substantially equal to the predetermined height of the cavity slot and the barricade including a plurality of parallel rails, the parallel rails extending orthogonally between the first and second support columns, and the parallel rails including a rigid right mounting bar and a rigid left mounting bar orthogonally mounted relative to the parallel rails at opposed respective right and left end portions of each of the parallel rails, the parallel rails directed coextensively relative to one another fixedly mounted to the respective right and left mounting bars, and including a plurality of equally spaced shock-absorbing spacer plates orthogonally mounted between the parallel rails, wherein the spacer plates are arranged parallel relative to the right and left mounting bars, the shock-absorbing spacer plates each including a plurality of rigid side plates, the side plates being arranged coextensively relative to one another, and the side plates including a resilient polymeric central web directed orthogonally between the parallel side plates, the central web including a plurality of polymeric resilient mounting webs directed orthogonally and integrally to the central web, and a plurality of rail openings directed through the central web, wherein each rail opening receives a rail therethrough.

2. An apparatus as set forth in claim 1 wherein each of the respective right and left mounting bars includes a plurality of guide collars, each guide collar positioned between a plurality of parallel rails and rigidly mounted to a respective mounting bar, and each guide collar slidably receiving one of said support columns therethrough.

3. An apparatus as set forth in claim 2 wherein each guide collar includes a first bore coaxially spaced from a second bore, the first bore fixedly receiving one of said mounting bars therewithin, and the second bore slidably receiving one of said support columns therethrough, and each support column including a column guide rib fixedly and contiguously mounted to the exterior surface of each support column, and the second bore including a guide groove, the guide groove complementarily and slidably receiving one of said guide ribs therethrough.

4. An apparatus as set forth in claim 3 including a spacer member mounted between each guide rail and each collar, each spacer member including a spacer bore receiving one of said mounting bars therethrough.

5. An apparatus as set forth in claim 4 including a first spool, the first spool including a first drive motor, the first spool fixedly mounted to the top surface adjacent the first column, and the first spool including a first guide cable wound thereabout, the first guide cable directed upwardly adjacent the first column, and a first outer pulley and a first inner pulley mounted rotatably to an upper terminal end of the first column, and the first guide cable directed about the first outer pulley and the first inner pulley and directed downwardly along the first column fixedly secured to the barricade.

6. An apparatus as set forth in claim 5 including a second spool and a second drive motor mounted adjacent the second column to the top surface, wherein the second spool includes a second guide cable wound thereabout, wherein the second guide cable is directed upwardly along the second column exteriorly thereof, and further including a second outer pulley and a second inner pulley rotatably mounted adjacent an upper terminal end of the second column, and the second cable directed along the second outer pulley and the second inner pulley and directed downwardly along the second column along an interior surface thereof and mounted to the barricade.

* * * * *